US010801347B2

(12) United States Patent
Joo

(10) Patent No.: US 10,801,347 B2
(45) Date of Patent: Oct. 13, 2020

(54) SEALING ASSEMBLY AND GAS TURBINE INCLUDING THE SAME

(71) Applicant: DOOSAN HEAVY INDUSTRIES & CONSTRUCTION CO., LTD., Changwon-si, Gyeongsangnam-do (KR)

(72) Inventor: Hyun Woo Joo, Changwon-si (KR)

(73) Assignee: Doosan Heavy Industries Construction Co., Ltd, Gyeongsangnam-do (KR)

( * ) Notice: Subject to any disclaimer, the term of this patent is extended or adjusted under 35 U.S.C. 154(b) by 132 days.

(21) Appl. No.: 16/121,893

(22) Filed: Sep. 5, 2018

(65) Prior Publication Data

US 2019/0120073 A1 Apr. 25, 2019

(30) Foreign Application Priority Data

Oct. 23, 2017 (KR) ..... 10-2017-0137248

(51) Int. Cl.
*F01D 11/00* (2006.01)
*F01D 9/04* (2006.01)

(52) U.S. Cl.
CPC ..... *F01D 11/006* (2013.01); *F01D 9/04* (2013.01); *F01D 9/042* (2013.01); *F01D 11/005* (2013.01); *F05D 2240/55* (2013.01); *F05D 2240/80* (2013.01); *F05D 2250/184* (2013.01)

(58) Field of Classification Search
CPC ..... F01D 9/04; F01D 9/042; F01D 11/005; F01D 11/006; F05D 2240/55; F05D 2240/80; F05D 2250/184
See application file for complete search history.

(56) References Cited

U.S. PATENT DOCUMENTS 5,154,577 A * 10/1992 Kellock ..... F01D 11/005 277/641
5,868,398 A * 2/1999 Maier ..... F01D 11/005 277/643
6,254,333 B1 * 7/2001 Merry ..... F01D 5/187 29/889.2

(Continued)

FOREIGN PATENT DOCUMENTS

JP 2014-080920 A 5/2014
KR 20-0174662 Y1 4/2000
KR 2005-0042197 A 5/2005

*Primary Examiner* — Igor Kershteyn
(74) *Attorney, Agent, or Firm* — Invenstone Patent, LLC

(57) ABSTRACT

A sealing assembly for a gas turbine includes a plurality of sealing housings interposed between adjacent turbine disks of a multistage turbine, each sealing housing coupled to a turbine vane of a corresponding stage; and a sealing plate unit installed between adjacent sealing housings to seal a gap between the adjacent sealing housings. Each sealing housing includes a horizontal housing segment and a pair of vertical housing segments each having a lower end connected to horizontal housing segment. The sealing plate unit includes a horizontal plate installed in the horizontal housing segment, and a pair of vertical plates respectively installed in the pair of vertical housing segments. The horizontal housing segment includes a horizontal slot facing an adjacent sealing housing to receive the horizontal plate, and each vertical housing segment includes a vertical slot facing an adjacent sealing housing to receive a corresponding vertical plate.

17 Claims, 8 Drawing Sheets

(56) References Cited

U.S. PATENT DOCUMENTS

| | | | | |
|---|---|---|---|---|
| 9,664,057 | B2 * | 5/2017 | Feldmann | F01D 9/04 |
| 9,771,819 | B2 * | 9/2017 | Morgan | F01D 25/24 |
| 9,869,194 | B2 * | 1/2018 | Dev | F01D 11/005 |
| 2009/0238683 | A1 * | 9/2009 | Alvanos | F01D 11/001 415/173.7 |
| 2012/0128472 | A1 * | 5/2012 | Singh | F01D 9/041 415/178 |
| 2013/0202408 | A1 * | 8/2013 | Laurello | F01D 11/001 415/115 |
| 2013/0315708 | A1 * | 11/2013 | Rendon | F01D 11/001 415/110 |
| 2015/0001815 | A1 * | 1/2015 | Steiger | F01D 11/005 277/649 |
| 2015/0125289 | A1 * | 5/2015 | Maltaverne | F01D 5/147 415/209.2 |

* cited by examiner

【FIG. 1】
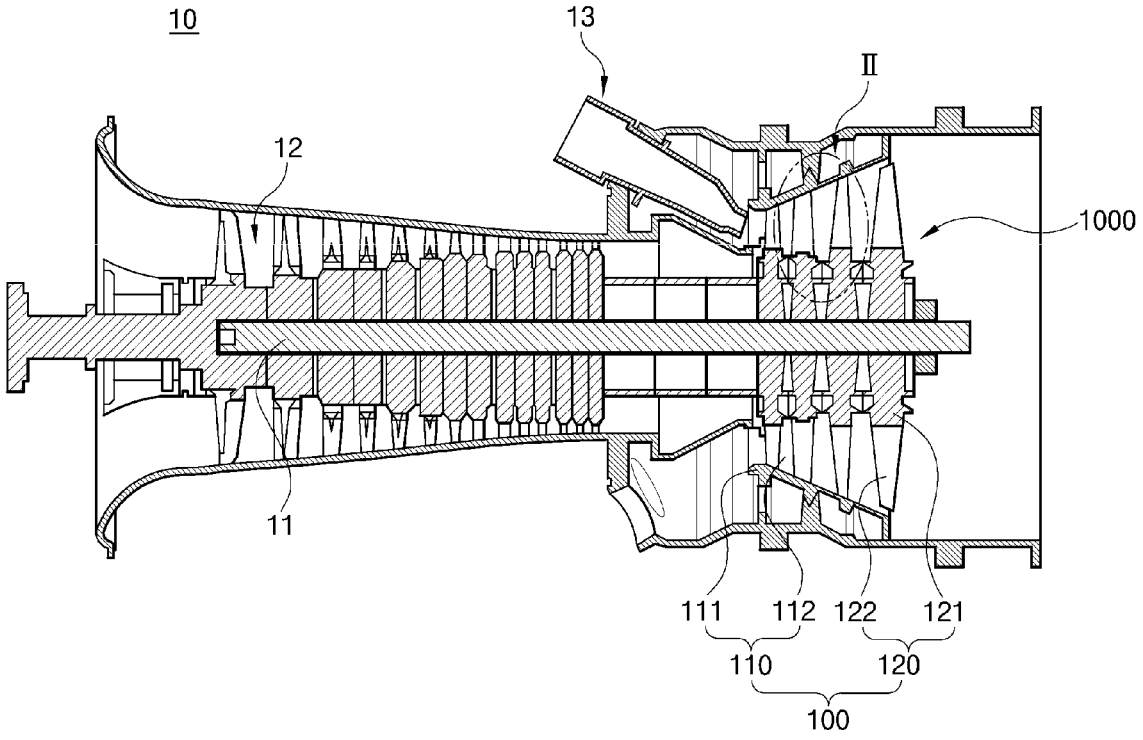

【FIG. 2】
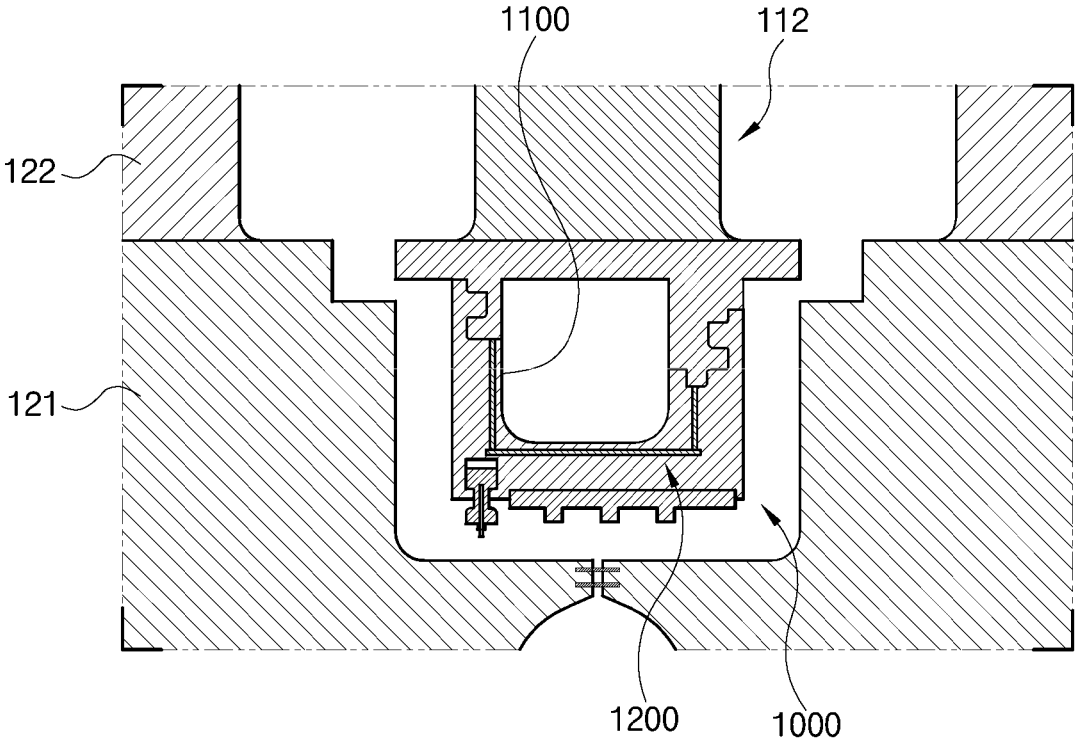

【FIG. 3】
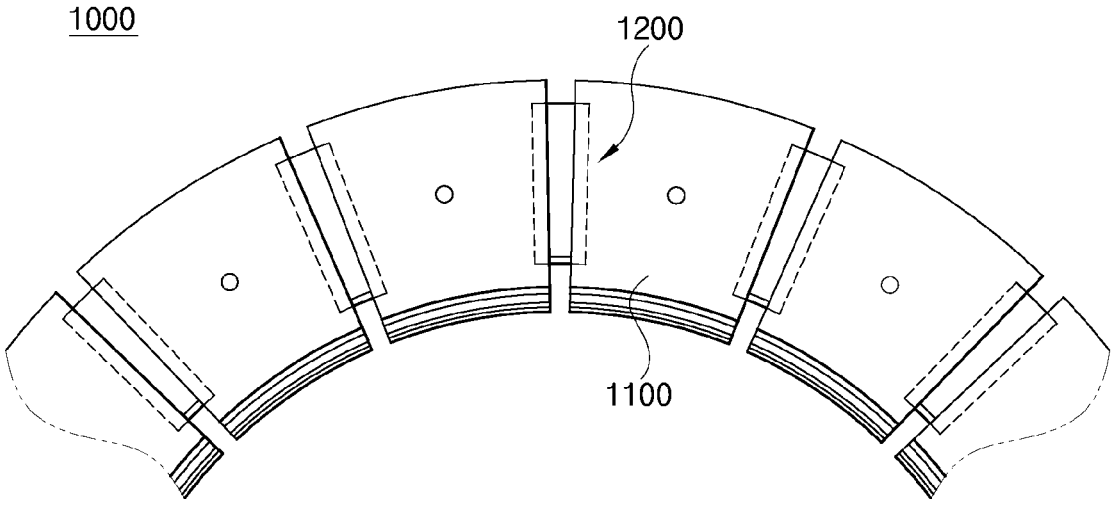

【FIG. 4】
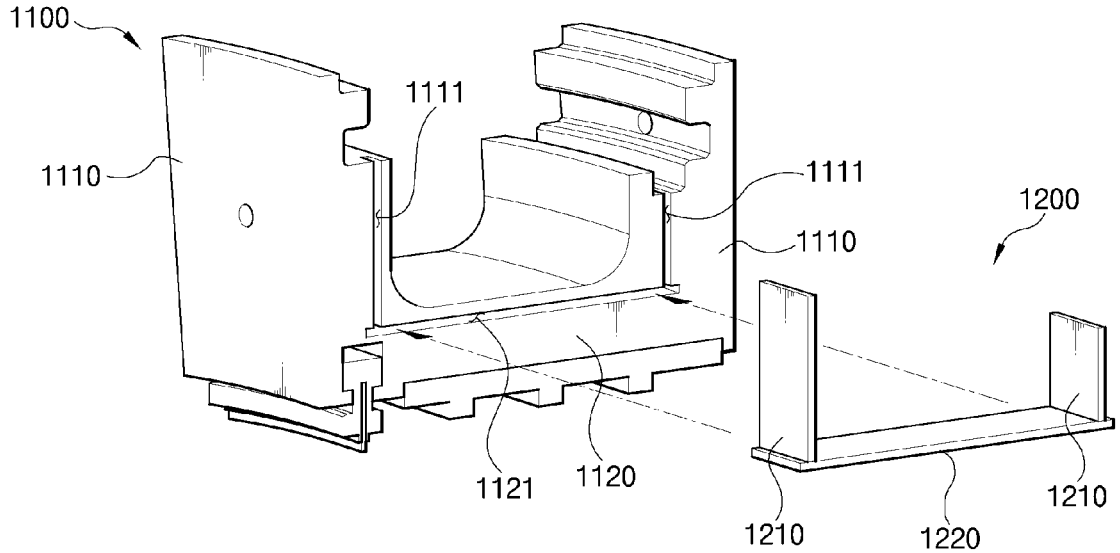

【FIG. 5】
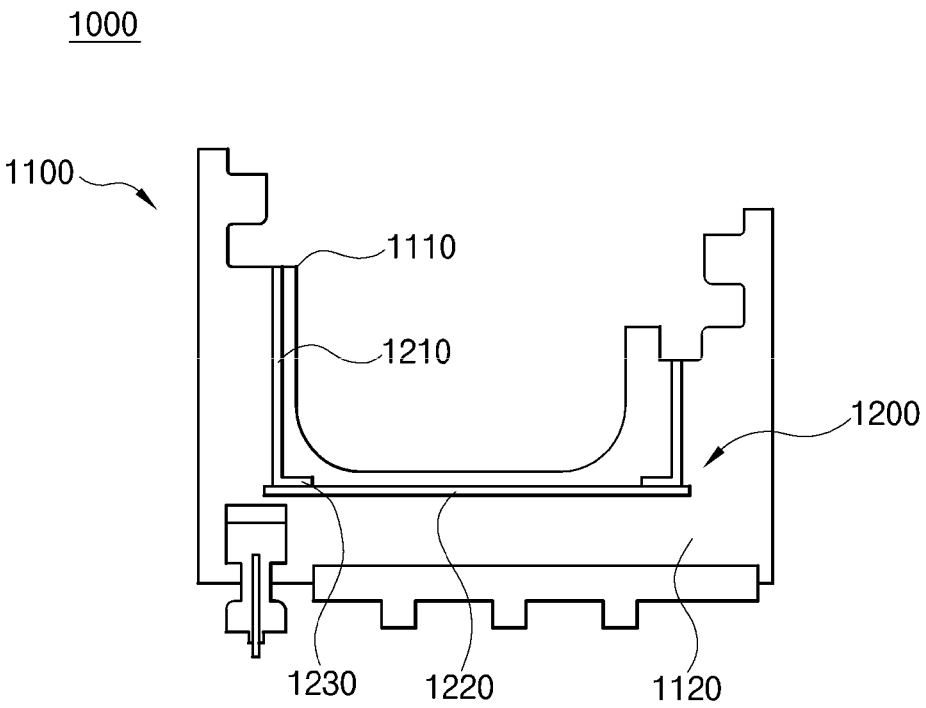

【FIG. 6】
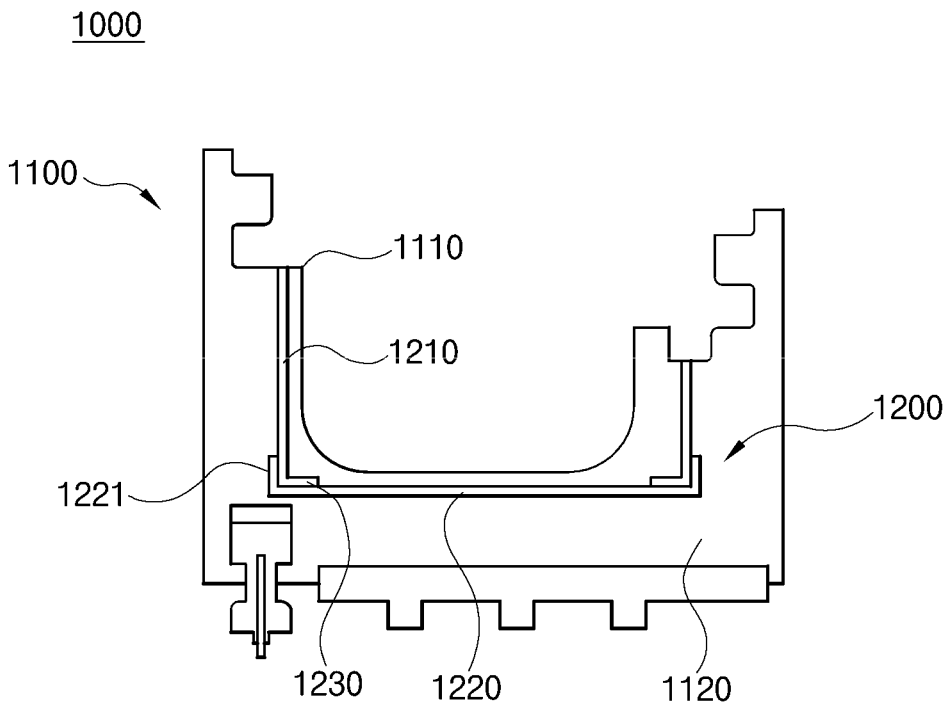

【FIG. 7】
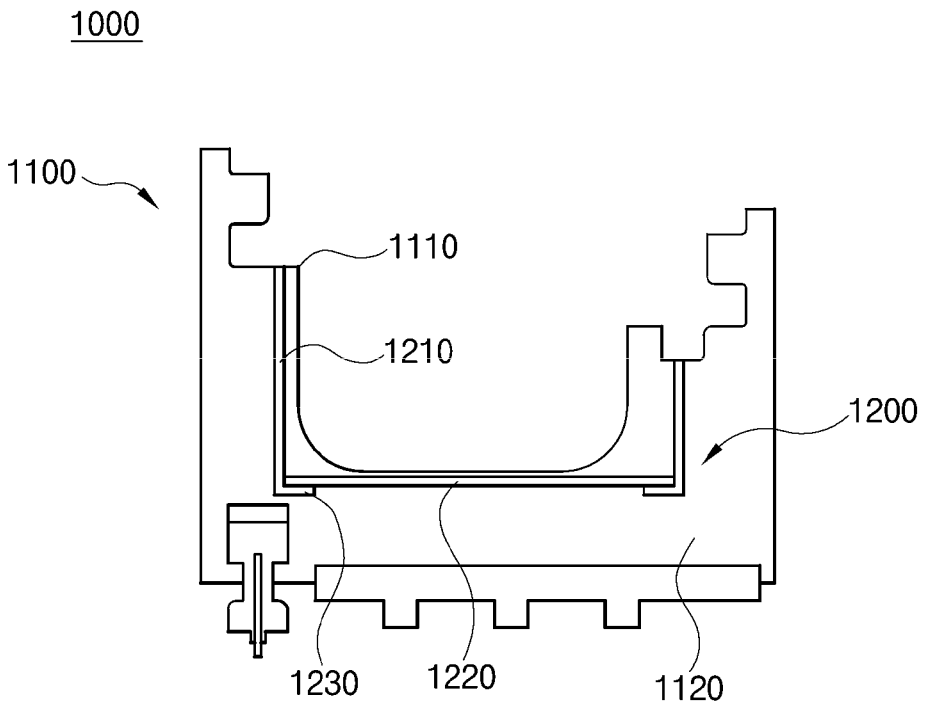

【FIG. 8】
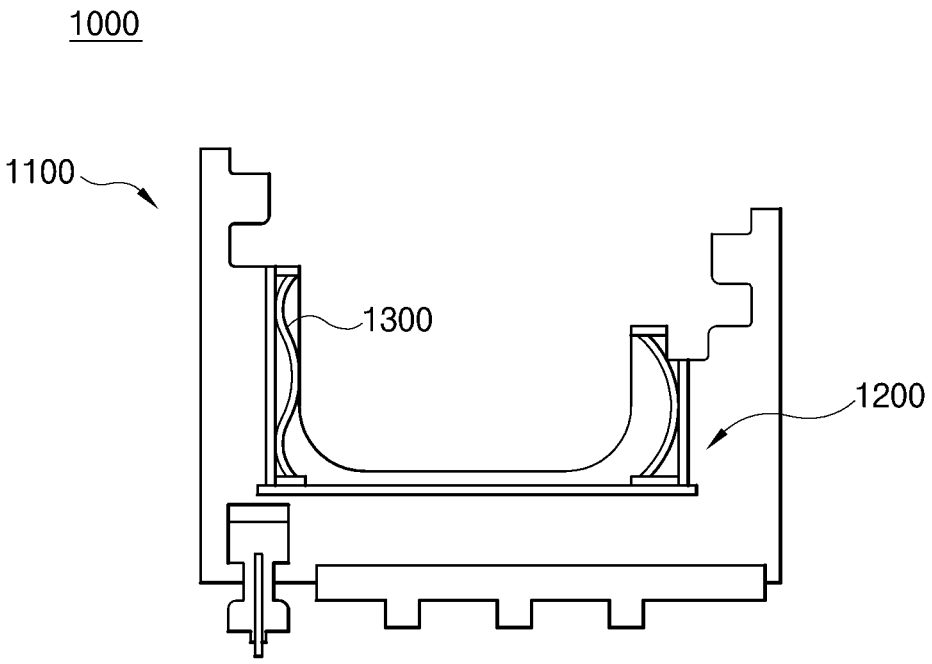

SEALING ASSEMBLY AND GAS TURBINE INCLUDING THE SAME

CROSS-REFERENCE TO RELATED APPLICATIONS

This application claims priority to Korean Patent Application No(s). 10-2017-0137248, filed on Oct. 23, 2017, the disclosure(s) of which is (are) incorporated herein by reference in its (their) entirety.

BACKGROUND OF THE DISCLOSURE

Field of the Disclosure

Exemplary embodiments of the present disclosure relate to sealing assemblies for gas turbines, and more particularly, to a sealing assembly installed on ends of turbine vanes to seal a space between disks of a turbine and to a gas turbine including the sealing assembly.

Description of the Related Art

Generally, a gas turbine includes a compressor, a combustor, and a turbine. The compressor includes a plurality of compressor vanes and a plurality of compressor blades which are alternately provided in a compressor casing. The compressor draws in external air through a compressor inlet scroll strut. The drawn air is compressed by the compressor vanes and the compressor blades while passing through an interior of the compressor.

The combustor receives air compressed by the compressor and mixes the compressed air with fuel. Furthermore, the combustor ignites, using an igniter, fuel mixed with compressed air, thus generating high-temperature and high-pressure combustion gas. Such generated combustion gas is supplied to the turbine.

The turbine includes a plurality of turbine vanes and a plurality of turbine blades which are alternately arranged in a turbine casing. The turbine receives combustion gas generated by the combustor and passes the combustion gas through its interior. Combustion gas passing through the interior of the turbine rotates the turbine blades, and combustion gas that has completely passed through the interior of the turbine is discharged out of the turbine through a turbine diffuser.

The gas turbine further includes a tie rod. The tie rod is installed to pass both through central portions of compressor disks each having an outer circumferential surface to which compressor blades are coupled, and through central portions of turbine disks each having an outer circumferential surface to which turbine blades are coupled. Hence, the tie rod makes it possible for the compressor disks and the turbine disks to be fixed to each other in the interior of the gas turbine.

Such a gas turbine does not have a reciprocating component such as a piston of a four-stroke engine. Therefore, mutual friction parts such as a piston-and-cylinder are not present, so that there is little consumption of lubricant. Therefore, the gas turbine is advantageous in that the amplitude of vibration is markedly reduced unlike a reciprocating machine having high-amplitude characteristics, and high-speed driving is possible so that high-capacity power can be produced.

The turbine includes a sealing housing coupled to an end of each of the turbine vanes to seal a space between the corresponding turbine disks. The sealing housing functions to prevent combustion gas passing through the turbine blades from being drawn into the space between the turbine disks.

In a contemporary gas turbine, a gap is formed between sealing housings disposed adjacent to each other in the same stage. Therefore, combustion gas is drawn through the gap between the sealing housings, or compressed air supplied to the sealing housings through the turbine vanes leaks out through the gap.

SUMMARY OF THE DISCLOSURE

An object of the present disclosure is to provide a sealing assembly having an improved structure capable of sealing a gap between sealing housings of a given stage, and a gas turbine including the sealing assembly.

In accordance with one aspect of the present disclosure, there is provided a sealing assembly for a gas turbine. The sealing assembly may include a plurality of sealing housings configured to be interposed between adjacent turbine disks of a multistage turbine of the gas turbine, each sealing housing coupled to a turbine vane of a corresponding stage; and a sealing plate unit installed between adjacent sealing housings of the plurality of sealing housings and configured to seal a gap between the adjacent sealing housings.

Each sealing housing may include a horizontal housing segment, and a pair of vertical housing segments disposed at positions spaced apart from each other in a direction toward the adjacent turbine disks, each vertical housing segment having a lower end connected to the horizontal housing segment, and the sealing plate unit may include a horizontal plate configured to be installed in the horizontal housing segment, and a pair of vertical plates disposed at positions spaced apart from each other and configured to be respectively installed in the pair of vertical housing segments.

The horizontal housing segment may include a horizontal slot facing a horizontal housing segment of an adjacent sealing housing of the plurality of sealing housings, the horizontal slot configured to receive the horizontal plate, and each vertical housing segment may include a vertical slot facing a corresponding vertical housing segment of the adjacent sealing housing, each vertical slot configured to receive a corresponding vertical plate.

The sealing plate unit may further include a vertical plate bend formed on a lower end of each vertical plate to be disposed toward the horizontal plate, each bend including a surface extending toward the other vertical plate bend. The horizontal plate may be interposed between the pair of vertical plates and disposed such that a lower surface of the horizontal plate comes into contact with an upper surface of each vertical plate bend.

The horizontal plate is disposed in contact with a lower surface of each bend. The sealing plate unit may further include a horizontal plate bend formed on each of opposite ends of the horizontal plate, each horizontal plate bend including a surface extending toward the turbine vane so as to enclose outer surfaces of the lower ends of the pair of vertical plates.

The sealing assembly may further include a pair of pressurizing springs respectively installed inside the pair of vertical plates and configured to respectively apply outward pressure to the pair of vertical plates.

The sealing assembly may further include a pressurizing spring installed inside the horizontal plate and configured to apply pressure to the horizontal plate.

In accordance with another aspect of the present disclosure, there is provided a sealing assembly for a gas turbine.

The sealing assembly may include a sealing housing configured to be interposed between adjacent turbine disks of a multistage turbine of the gas turbine and coupled to a turbine vane of a corresponding stage, the sealing housing including a plurality of slots formed in both sides of the sealing housing; and a sealing plate unit installed in one side of the sealing housing and configured to seal a gap between the sealing housing and another sealing housing, the sealing plate unit including a plurality of plates configured to be simultaneously inserted into the plurality of slots formed in the one side of the sealing housing and into a plurality of slots formed in one side of the other sealing housing, wherein the plurality of slots formed in the other side of the sealing housing are configured to receive a plurality of plates inserted into a plurality of slots formed in the other side of the other sealing housing. The one side of the sealing housing includes first surfaces of each of a horizontal housing segment and a pair of vertical housing segments connected to the horizontal housing segment, and the other side of the sealing housing includes second surfaces of each of the horizontal housing segment and the pair of vertical housing segments. The plurality of plates may include a horizontal plate configured to be installed in the first surface of the horizontal housing segment, and a pair of vertical plates configured to be respectively installed in the first surfaces of the pair of vertical housing segments.

In accordance with another aspect of the present disclosure, there is provided a gas turbine including a compressor to draw in air and compress the air; a combustor to produce combustion gas by mixing the compressed air with fuel and combusting the mixture; a multistage turbine to generate a driving force by passing the combustion gas through an interior of the turbine; and a tie rod passing through central portions of the compressor and the turbine. The turbine may include a stator including a casing; a plurality of turbine vanes installed on an inner circumferential surface of the casing, each turbine vane having a lower end facing the tie rod; and a sealing assembly installed on the lower end of each turbine vane and configured to seal a space between adjacent turbine disks of a plurality of turbine disks; and a rotor including the plurality of turbine disks installed in the casing, and a plurality of turbine blades coupled to outer circumferential surfaces of each turbine disk and disposed between respective stages of the turbine vanes, the rotor being configured to be rotated by the combustion gas. The sealing assembly of the stator may include a plurality of sealing housings configured to be interposed between the adjacent turbine disks; and a sealing plate unit installed between adjacent sealing housings of the plurality of sealing housings and configured to seal a gap between the adjacent sealing housings.

In a sealing assembly and a gas turbine including the same in accordance with the present disclosure, the sealing assembly includes a sealing plate unit interposed between sealing housings of a given stage, whereby combustion gas may be prevented from being drawn into a gap between the sealing housings, and compressed air may be prevented from leaking out through the gap.

BRIEF DESCRIPTION OF THE DRAWINGS

The above and other objects, features and other advantages of the present disclosure will be more clearly understood from the following detailed description taken in conjunction with the accompanying drawings, in which:

FIG. 1 is a schematic sectional view of a gas turbine to which an embodiment of the present disclosure is applied;

FIG. 2 is an enlarged view of portion II of FIG. 1;

FIG. 3 is a diagram illustrating annular arrangement of a sealing assembly shown in FIG. 2;

FIG. 4 is an exploded perspective view illustrating a coupling structure of the sealing assembly of FIG. 3; and FIGS. 5 to 8 are front views respectively illustrating sealing assemblies in accordance with first to fourth embodiments of the present disclosure.

DESCRIPTION OF SPECIFIC EMBODIMENTS

While the present disclosure will be described with respect to specific embodiments illustrated in the accompanying drawings, these are only for illustrative purposes, and it will be apparent to those skilled in the art that various changes and other equivalent embodiments may be derived from the specific embodiments. Accordingly, the scope of the present disclosure should be determined only according to the attached claims.

Hereinafter, embodiments of a sealing assembly and a gas turbine including the sealing assembly in accordance with the present disclosure will be described with reference to the accompanying drawings.

Referring to FIG. 1, a gas turbine 10 in accordance with the present disclosure includes a compressor 12, a combustor 13, and a turbine 100. Based on a flow direction of gas (compressed air or combustion gas), the compressor 12 is disposed at an upstream side of the gas turbine 10, and the turbine 100 is disposed at a downstream side of the gas turbine 10. The combustor 13 is disposed between the compressor 12 and the turbine 100.

The compressor 12 houses compressor vanes and compressor rotors in a compressor casing. The turbine 100 houses turbine vanes 112 and turbine rotors 120 in a turbine casing 111. The compressor vanes and the compressor rotors are disposed in a multi-stage structure along the flow direction of compressed air. The turbine vanes 112 and the turbine rotors 120 are also disposed in a multi-stage structure along the flow direction of compressed gas. Here, the compressor 12 is designed such that an internal space in which air flows is gradually reduced in size from a front stage to a rear stage so that air drawn into the compressor 12 can be compressed. In contrast, the turbine 100 is designed to have a structure such that its internal space is gradually increased in size from a front stage to a rear stage so that combustion gas supplied from the combustor 13 can expand.

A torque tube functioning as a torque transmission member for transmitting rotational torque generated from the turbine 100 to the compressor 12 is disposed between the compressor rotor that is disposed at the rearmost stage of the compressor 12 and the turbine rotor 120 that is disposed at the foremost stage of the turbine 100. As shown in FIG. 1, the torque tube may be configured of a plurality of torque tube disks arranged in a three-stage structure, but this is only one of various embodiments of the present disclosure. The torque tube may be configured of a plurality of torque tube disks arranged in a structure of four or more stages or a structure of two or fewer stages.

Each compressor rotor includes a compressor disk and compressor blades. In the compressor casing, a plurality (e.g., fourteen) of compressor rotor disks are provided. The compressor rotor disks are coupled by the tie rod 11 such that the compressor rotor disks are not spaced apart from each other in an axial direction. In more detail, the compressor disks are arranged along the axial direction of the tie rod 11 passing through approximately central portions of the compressor disks. Here, facing surfaces of adjacent compressor disks are pressed against each other by the tie rod 11, whereby the compressor disks cannot rotate relative to each other.

A plurality of compressor blades are radially coupled to an outer circumferential surface of each of the compressor disks. Furthermore, a plurality of compressor vanes installed on an inner circumferential surface of the compressor casing are arranged into an annular configuration for a given stage, and one annular configuration of plural compressor vanes is disposed between the rotating compressor blades of each of a pair of adjacent compressor disks corresponding to the given stage. Unlike the compressor disks, the compressor vanes remain fixed to the compressor casing and do not rotate. Each vane functions to align the flow of compressed air that has passed through the compressor blades of an upstream compressor disk of the pair of adjacent compressor disks, and to guide the compressed air to the compressor blades of the ensuing downstream compressor disk. Here, the compressor casing and the compressor vanes are stationary bodies and may be comprehensively defined as a compressor stator, so as to be distinguished from compressor rotors, which are rotational bodies.

The tie rod 11 is disposed passing through central portions of the plurality of compressor disks and turbine disks, which will be described later herein. One end of the tie rod 11 is coupled to the interior of the compressor disk that is disposed at the foremost side of the compressor 12, and the other end is coupled by a fastening nut.

The configuration of the tie rod 11 is not limited to that of FIG. 1 and may be variously structured depending on the structure of the gas turbine 10. In other words, as shown in the drawing, a single tie rod 11 may be configured in such a way that it passes through the central portions of the compressor disks and the turbine disks, but also a plurality of tie rods 11 may be arranged in a circumferential direction, or the gas turbine 10 may employ a combination of the singular and plural tie rod configurations.

Although not shown, a deswirler as a guide vane may be installed in the compressor of the gas turbine so as to adjust a flow angle of fluid to a designed flow angle, the fluid entering an inlet of the combustor after the pressure of the fluid has been increased.

The combustor mixes introduced compressed air with fuel, combusts the fuel mixture to generate high-temperature and high-pressure combustion gas having high energy, and increases, through an isobaric combustion process, the temperature of the combustion gas to a heat-resistant temperature limit at which components of the combustor and the turbine can endure.

A combustion system of the gas turbine may include a plurality of combustors arranged in a combustor casing formed in a cell shape. Each of the combustors includes a nozzle for ejecting fuel, a liner forming a combustion chamber, and a transition piece serving as a connector between the combustor and the turbine.

In detail, the liner provides a combustion space in which fuel discharged from the fuel injection nozzle is mixed with compressed air supplied from the compressor and then combusted. The liner may include a combustion chamber for providing the combustion space in which the fuel mixed with air is combusted, and a liner channel forming an annular space enclosing the combustion chamber. The nozzle for ejecting fuel is coupled to a front end of the liner, and an igniter is coupled to a sidewall of the liner.

Compressed air introduced through a plurality of holes formed in an outer wall of the liner flows in the liner channel. Compressed air used to cool the transition piece, to be described later herein, also flows through liner channel. As such, since compressed air flows along the outer wall of the liner, the liner may be prevented from being damaged by heat generated by combustion of fuel in the combustion chamber.

The transition piece is connected to a rear end of the liner so as to transfer combustion gas combusted by an ignition plug toward the turbine. In the same manner as the liner and liner channel, the transition piece includes a transition piece channel forming an annular space surrounding an internal space of the transition piece. An outer wall of the transition piece may be cooled by compressed air flowing along the transition piece channel so that the transition piece may be prevented from being damaged by high-temperature combustion gas.

High-temperature, high-pressure combustion gas that has come out of the combustor is supplied into the above-described turbine and expands while passing through the interior of the turbine. Thereby, impulsive force and reaction force are applied to turbine blades so that rotational torque can be generated. The obtained rotational torque is transmitted to the compressor via the torque tube. Power that exceeds the power needed to drive the compressor is used to drive a generator, etc.

The turbine 100 basically has a structure similar to that of the compressor. In detail, the turbine 100 includes a plurality of turbine rotors 120 similar to the compressor rotors of the compressor. Therefore, each turbine rotor 120 also includes a turbine disk 121, and a plurality of turbine blades 122 which are radially disposed on the turbine disk 121. Also, a plurality of turbine vanes 112 installed on an inner circumferential surface of the turbine casing 111 are arranged into an annular configuration or a given stage, and one annular configuration of plural turbine vanes is disposed between the rotating turbine blades 122 of each of a pair of adjacent turbine disks 121 corresponding to the given stage. The turbine vanes 112 function to guide the flow direction of combustion gas passing through the turbine blades 122. Here, the turbine casing 111 and the turbine vanes 112 are stationary bodies and may be comprehensively defined as a turbine stator 110 so as to be distinguish from the turbine rotors 120, which are rotational bodies.

Referring to FIGS. 2 to 4, the stator 110 further includes a sealing assembly 1000 which is installed on one end of each of the plurality of vanes 112 so as to seal a space between the disks 121. The sealing assembly 1000 includes a sealing housing 1100 and a sealing plate unit 1200.

The sealing housing 1100 is coupled to a distal end of each vane 112 toward the tie rod 11 and is interposed between the disks 121. The sealing housing 1100 functions to prevent combustion gas passing through the blades 122 from being drawn into the space between the disks 121. Here, the sealing housing 1100 may be formed of a pair of vertical housing segments 1110 and one horizontal housing segment 1120 coupled to the vertical housing segments 1110. The pair of vertical housing segments 1110 are disposed at positions spaced apart from each other in a direction toward the adjacent disks 121. The horizontal housing segment 1120 is coupled to an end of each vertical housing segment 1110 and arranged toward the tie rod 11, the end connected to the horizontal housing segment 1120 herein also referred to as a lower end. Thus, the lower ends of the pair of vertical housing segments 1110 are connected to each other by the horizontal housing segment 1120.

In the same stage in which the vanes 112 are arranged into an annular configuration, the sealing plate unit 1200 is respectively installed between every pair of adjacent sealing housings 1100 in order to seal the inherent gaps present between the circumferentially arranged sealing housings 1100. In detail, based on any one stage, the vanes 112 are installed to form an annular shape along an inner circumferential surface of the casing 111, which has the general shape of a truncated cone. The sealing plate unit 1200 is interposed between adjacent sealing housings 1100 in the same stage rather than between stages. Thereby, the sealing plate unit 1200 prevents combustion gas passing through the blades 122 from being drawn through a gap between the sealing housings 1100 and prevents compressed air supplied from the compressor 12 to the vanes 112 and the sealing housings 1100 from leaking out of the sealing housings 1100.

The sealing plate unit 1200 includes a horizontal plate 1220 and a pair of vertical plates 1210 each having one end connected to the horizontal plate 1220 and arranged toward the tie rod 11, the end connected to the horizontal plate 1220 herein also referred to as a lower end. The pair of vertical plates 1210 are disposed at positions spaced apart from each other in an axial direction, that is, toward an adjacent disk 121, and are respectively installed in the pair of vertical housing segments 1110. The horizontal plate 1220 is installed in the horizontal housing segment 1120.

Here, a vertical slot 1111 is formed in both side surfaces of each vertical housing segment 1110, wherein one side surface of each vertical housing segment 1110 faces a corresponding surface of an adjacent vertical housing segment 1110 of the same stage. Similarly, a horizontal slot 1121 is formed in both side surfaces of the horizontal housing segment 1120, wherein one side surface of the horizontal housing segment 1120 faces a corresponding surface of an adjacent horizontal housing segment 1120 of the same stage. The pair of vertical plates 1210 are inserted into the respective vertical slots 1111, and the horizontal plate 1220 is inserted into the horizontal slot 1121, whereby the gap between the adjacent sealing housings 1100 can be sealed.

However, the configuration of the vertical slots 1111 and the horizontal slot 1121 shown in FIG. 4 is only one of various embodiments of the present disclosure. The vertical slots 1111 and the horizontal slot 1121 may each be variously shaped depending on the configuration of sealing plate units 1200 included in sealing assemblies 1000 in accordance with first to fourth embodiments of the present disclosure, which will be described later herein.

Hereinafter, the gas turbine 10 and the sealing assemblies 1000 in accordance with the first to fourth embodiments of the present disclosure will be described in detail with reference to FIGS. 5 to 8.

Referring to FIG. 5, the sealing plate unit 1200 may further include a bend 1230 formed on the lower end of each vertical plate 1210 to be disposed toward the horizontal plate 1220, each bend 1230 including a surface extending toward the other bend 1230. The horizontal plate 1220 may be disposed in contact with a lower surface of each bend 1230, the lower surface facing toward the tie rod 11. Here, contacting portions between the horizontal plate 1220 and each bend 1230 may be joined by welding or fixed to each other by a separate coupling unit.

In the case of the sealing plate unit 1200 having the above structure, since compressed air supplied from the vanes 112 toward the sealing housing 1100 applies pressure to upper surfaces of the bends 1230, the airtightness between the horizontal plate 1220 and the bends 1230 can be enhanced. Hence, the sealing plate unit 1200 may prevent combustion gas from being drawn through the gap between the adjacent sealing housings 1100 and may prevent compressed air from leaking out through the same gap.

Here, as shown in FIG. 6, the sealing plate unit 1200 may further include a bend 1221 formed on each of opposite ends of the horizontal plate 1220 to respectively face the adjacent disks 121, each bend 1221 including a surface extending toward the vane 112 so as to enclose outer surfaces of the lower ends of the pair of vertical plates 1210. In this case, since contact surfaces between the vertical plates 1210, the horizontal plate 1220, and the bends 1230 are formed to meander, gas may be more effectively prevented from being drawn into a gap between the vertical plates 1210 and the horizontal plate 1220 or leaking therefrom.

Referring to FIG. 7, the horizontal plate 1220 may be interposed between the pair of vertical plates 1210 and disposed such that a lower surface of the horizontal plate 1220 comes into contact with the upper surfaces of the bends 1230. Furthermore, contacting portions between the horizontal plate 1220 and each bend 1230 may be joined by welding or fixed to each other by a separate coupling unit. In this case, since compressed air supplied from the vanes 112 toward the sealing housing 1100 applies pressure to an upper surface of the horizontal plate 1220, the airtightness between the horizontal plate 1220 and the bends 1230 may be enhanced. Hence, the sealing plate unit 1200 may prevent combustion gas from being drawn through the gap between the adjacent sealing housings 1100 and may prevent compressed air from leaking out through the same gap.

Referring to FIG. 8, the sealing assembly 1000 may further include a pair of pressurizing springs 1300, which are respectively installed inside the pair of vertical plates 1210 and apply outward pressure to the vertical plates 1210. Thereby, the pair of pressurizing springs 1300 may enhance the airtightness between the pair of vertical plates 1210 and the vertical housing segments 1110, thus preventing combustion gas from being drawn through the gap between the adjacent sealing housings 1100 and compressed air from leaking out through the same gap. Here, although the example of FIG. 8 shows a particular configuration of pressurizing springs 1300 to be installed inside the respective vertical plates 1210, the present disclosure is not limited thereto. Moreover, a configuration of pressurizing springs may, alternatively or additionally, be installed inside the horizontal plate 1220.

As described above, in a sealing assembly 1000 and a gas turbine 10 including the same in accordance with the present disclosure, a sealing plate unit 1200 is interposed between adjacent sealing housings 1100 for a given stage of a multistage turbine of the gas turbine 10. Thereby, combustion gas may be prevented from being drawn into a space between the adjacent sealing housings 1100, and compressed air may be prevented from leaking out of the sealing housings 1100 through the space.

While the present disclosure has been described with respect to the specific embodiments, it will be apparent to those skilled in the art that various changes and modifications may be made without departing from the spirit and scope of the disclosure as defined in the following claims.

What is claimed is:

1. A sealing assembly for a gas turbine, comprising:

a plurality of sealing housings configured to be interposed between adjacent turbine disks of a multistage turbine of the gas turbine, each sealing housing being coupled to a turbine vane of a corresponding stage and including a horizontal housing segment and a pair of vertical housing segments disposed at positions spaced apart from each other in a direction toward the adjacent turbine disks, each vertical housing segment having a lower end connected to the horizontal housing segment; and a sealing plate unit installed between adjacent sealing housings of the plurality of sealing housings and configured to seal a gap between the adjacent sealing housings, the sealing plate unit comprising:

a horizontal plate configured to be installed in the horizontal housing segment, a pair of vertical plates disposed at positions spaced apart from each other and configured to be respectively installed in the pair of vertical housing segments, and a vertical plate bend formed on a lower end of each vertical plate to be disposed toward the horizontal plate, each bend including a surface extending toward the other vertical plate bend.

2. The sealing assembly according to claim 1, wherein the horizontal housing segment includes a horizontal slot facing a horizontal housing segment of an adjacent sealing housing of the plurality of sealing housings, the horizontal slot configured to receive the horizontal plate, and wherein each vertical housing segment includes a vertical slot facing a corresponding vertical housing segment of the adjacent sealing housing, each vertical slot configured to receive a corresponding vertical plate.

3. The sealing assembly according to claim 2, wherein each vertical housing segment further includes a radially outward facing surface configured to receive a root of the turbine vane, and wherein the vertical slot of each vertical housing segment has a radially outer end communicating with the radially outward facing surface of a corresponding vertical housing segment, the radially outer end of the vertical slot configured to receive a radially outer end of the corresponding vertical plate so that the received radially outer end is flush with the radially outward facing surface.

4. The sealing assembly according to claim 1, wherein the horizontal plate is interposed between the pair of vertical plates and disposed such that a lower surface of the horizontal plate comes into contact with an upper surface of each vertical plate bend.

5. The sealing assembly according to claim 1, wherein the horizontal plate is disposed in contact with a lower surface of each bend.

6. The sealing assembly according to claim 5, wherein the sealing plate unit further comprises a horizontal plate bend formed on each of opposite ends of the horizontal plate, each horizontal plate bend including a surface extending toward the turbine vane so as to enclose outer surfaces of the lower ends of the pair of vertical plates.

7. The sealing assembly according to claim 1, further comprising a pair of pressurizing springs respectively installed inside the pair of vertical plates and configured to respectively apply outward pressure to the pair of vertical plates.

8. The sealing assembly according to claim 1, further comprising a pressurizing spring installed inside the horizontal plate and configured to apply pressure to the horizontal plate.

9. A sealing assembly for a gas turbine, comprising:

a sealing housing configured to be interposed between adjacent turbine disks of a multistage turbine of the gas turbine and coupled to a turbine vane of a corresponding stage, the sealing housing including a plurality of slots formed in both sides of the sealing housing; and a sealing plate unit installed in one side of the sealing housing and configured to seal a gap between the sealing housing and another sealing housing, the sealing plate unit including a plurality of plates configured to be simultaneously inserted into the plurality of slots formed in the one side of the sealing housing and into a plurality of slots formed in one side of the other sealing housing, wherein the plurality of slots formed in the other side of the sealing housing are configured to receive a plurality of plates inserted into a plurality of slots formed in the other side of the other sealing housing, wherein the one side of the sealing housing includes first surfaces of each of a horizontal housing segment and a pair of vertical housing segments connected to the horizontal housing segment, and the other side of the sealing housing includes second surfaces of each of the horizontal housing segment and the pair of vertical housing segments, wherein the plurality of plates comprise a horizontal plate configured to be installed in the first surface of the horizontal housing segment, and a pair of vertical plates configured to be respectively installed in the first surfaces of the pair of vertical housing segments, wherein each vertical housing segment includes a radially outward facing surface configured to receive a root of the turbine vane, and wherein the vertical slot of each vertical housing segment has a radially outer end communicating with the radially outward facing surface of a corresponding vertical housing segment, the radially outer end of the vertical slot configured to receive a radially outer end of the corresponding vertical plate so that the received radially outer end is flush with the radially outward facing surface.

10. A gas turbine comprising a compressor to draw in air and compress the air; a combustor to produce combustion gas by mixing the compressed air with fuel and combusting the mixture; a multistage turbine to generate a driving force by passing the combustion gas through an interior of the turbine; and a tie rod passing through central portions of the compressor and the turbine, the turbine comprising:

a stator including a casing; a plurality of turbine vanes installed on an inner circumferential surface of the casing, each turbine vane having a lower end facing the tie rod; and a sealing assembly installed on the lower end of each turbine vane and configured to seal a space between adjacent turbine disks of a plurality of turbine disks; and a rotor including the plurality of turbine disks installed in the casing, and a plurality of turbine blades coupled to outer circumferential surfaces of each turbine disk and disposed between respective stages of the turbine vanes, the rotor being configured to be rotated by the combustion gas, wherein the sealing assembly of the stator comprises:

a plurality of sealing housings configured to be interposed between the adjacent turbine disks, each sealing housing including a horizontal housing segment and a pair of vertical housing segments disposed at positions spaced apart from each other in a direction toward the adjacent turbine disks, each vertical housing segment having a lower end connected to the horizontal housing segment; and a sealing plate unit installed between adjacent sealing housings of the plurality of sealing housings and configured to seal a gap between the adjacent sealing housings, the sealing plate unit comprising:

a horizontal plate configured to be installed in the horizontal housing segment, a pair of vertical plates disposed at positions spaced apart from each other and configured to be respectively installed in the pair of vertical housing segments, and a vertical plate bend formed on a lower end of each vertical plate to be disposed toward the horizontal plate, each bend including a surface extending toward the other vertical plate bend.

11. The gas turbine according to claim 10, wherein the horizontal housing segment includes a horizontal slot facing a horizontal housing segment of an adjacent sealing housing of the plurality of sealing housings, the horizontal slot configured to receive the horizontal plate, and wherein each vertical housing segment includes a vertical slot facing a corresponding vertical housing segment of the adjacent sealing housing, each vertical slot configured to receive a corresponding vertical plate.

12. The gas turbine according to claim 11, wherein each vertical housing segment further includes a radially outward facing surface configured to receive a root of the turbine vane, and wherein the vertical slot of each vertical housing segment has a radially outer end communicating with the radially outward facing surface of a corresponding vertical housing segment, the radially outer end of the vertical slot configured to receive a radially outer end of the corresponding vertical plate so that the received radially outer end is flush with the radially outward facing surface.

13. The gas turbine according to claim 10, wherein the horizontal plate is interposed between the pair of vertical plates and disposed such that a lower surface of the horizontal plate comes into contact with an upper surface of each vertical plate bend.

14. The gas turbine according to claim 10, wherein the horizontal plate is disposed in contact with a lower surface of each bend.

15. The gas turbine according to claim 14, wherein the sealing plate unit further comprises a horizontal plate bend formed on each of opposite ends of the horizontal plate, each horizontal plate bend including a surface extending toward the turbine vane so as to enclose outer surfaces of the lower ends of the pair of vertical plates.

16. The gas turbine according to claim 10, further comprising a pair of pressurizing springs respectively installed inside the pair of vertical plates and configured to respectively apply outward pressure to the pair of vertical plates.

17. The gas turbine according to claim 10, further comprising a pressurizing spring installed inside the horizontal plate and configured to apply pressure to the horizontal plate.

* * * * *